US007443355B2

(12) United States Patent
Griffiths

(10) Patent No.: US 7,443,355 B2
(45) Date of Patent: Oct. 28, 2008

(54) ANTENNA FEED-TUBE-TO-AMPLIFIER COUPLING

(75) Inventor: Gary D. Griffiths, Cranston, RI (US)

(73) Assignee: KVH Industries, Inc., Middletown, RI (US)

( * ) Notice: Subject to any disclaimer, the term of this patent is extended or adjusted under 35 U.S.C. 154(b) by 0 days.

(21) Appl. No.: 11/558,220

(22) Filed: Nov. 9, 2006

(65) Prior Publication Data

US 2008/0111758 A1 May 15, 2008

(51) Int. Cl.

| | |
|---|---|
| ***H01Q 13/00*** | (2006.01) |
| ***H01Q 19/12*** | (2006.01) |
| ***H01Q 21/00*** | (2006.01) |
| ***H01Q 19/10*** | (2006.01) |

(52) U.S. Cl. ..... 343/786; 343/840; 343/781 CA; 343/781 P; 343/836; 343/837

(58) Field of Classification Search ..... 343/786, 343/840, 781 CA, 781 P, 836, 837
See application file for complete search history.

(56) References Cited

U.S. PATENT DOCUMENTS 6,494,426 B1 * 12/2002 Wilks ..... 248/222.14
2005/0068241 A1 * 3/2005 Desargant et al. ..... 343/781 CA

FOREIGN PATENT DOCUMENTS

JP 61133701 A * 6/1986

* cited by examiner

*Primary Examiner*—Douglas W. Owens
*Assistant Examiner*—Jennifer F Chang
(74) *Attorney, Agent, or Firm*—Foley Hoag LLP

(57) ABSTRACT

A first set of screws secures a Cassegrain-configuration microwave antenna's primary reflector to its low-noise block down-converter without additionally securing that reflector or the low-noise block down-converter to the antenna's feed tube, which a second set of screws separately secures to the low-noise block down-converter.

14 Claims, 5 Drawing Sheets

ANTENNA FEED-TUBE-TO-AMPLIFIER COUPLING

BACKGROUND OF THE INVENTION

1. Field of the Invention

The present invention is directed to antennas for receiving satellite signals. It finds particular application in antennas for use on mobile platforms.

2. Background Information

A typical mobile satellite antenna has a stationary base mounted to its platform, such as a boat or recreational vehicle, and a satellite-following rotatable assembly is mounted on the base for two- or three-axis rotation with respect to the base. That rotatable assembly includes a primary reflector, a secondary shaped sub-reflector, and a low-noise block down-converter, and it may also include gyroscopes for providing sensor inputs to the rotatable assembly's orientation-control system.

The reflectors are often arranged in Cassegrain configuration: microwaves from a small solid angle of sky are reflected by the paraboloidal primary reflector onto the smaller sub-reflector disposed in front the primary reflector. From the sub-reflector those microwaves are directed through a central opening in the primary reflector to the low-noise block down-converter. In some antennas, the sub-reflector focuses the radiation not to a point behind the primary reflector's central opening but rather to the mouth of a waveguide, or "feed tube," disposed in front of the primary reflector to guide radiation through the primary-reflector opening to the low-noise block down-converter. The low-noise block down-converter down-converts a block of microwave television or other communications channels to an intermediate-frequency range, at which the channel signals propagate by cable off the rotating assembly to an IF strip mounted on the stationary base.

A typical mounting arrangement for this configuration includes a motor-driven turntable journaled in the base for rotation about one axis with respect to the base. Bearings on the turntable in turn journal the primary reflector for rotation with respect to an axis in the turntable's frame of reference, and a second servomotor cooperates with the turntable servomotor to keep the primary reflector aimed at the desired satellite.

The other rotatable-assembly elements are mounted in turn on the primary reflector. Conventionally, this is accomplished by providing a mounting bracket for the gyroscopes, which are disposed behind the primary reflector, and employing bolts to secure the low-noise block down-converter to the feed tube in such a manner as to sandwich the primary reflector and gyro bracket between them. The sub-reflector is in turn mounted on the feed tube, from which it is spaced by a reflector-mounting tube that is made of microwave-transparent material so that the feed tube does not block the path of microwaves traveling from the primary reflector to the sub-reflector.

SUMMARY OF THE INVENTION

I have recognized, though, that the conventional mounting approach makes it harder than necessary to achieve a good fit of the feed tube to the low-noise block down-converter. By a subtle change in the assembly, I have devised a way of achieving a good fit more reliably and in a way that makes assembly and disassembly easier. Although I still secure the feed tube to the low-noise block down-converter (possibly through a bracket), I do not rely primarily on that connection for their support by the primary reflector. Instead, I secure one or the other of those two elements to the primary reflector independently of the feed tube's connection to the low-noise block down-converter, and I then secure the feed tube and low-noise block down-converter to each other. This makes assembly and disassembly easier because only two separate parts have to be handled at a time rather than three.

Moreover, since this arrangement's mounting of the feed tube and low-noise block converter on the principal reflector does not rely on their sandwiching that reflector between them, it eliminates a source of tolerance accumulation. Axial spacing between the ends of the feed tube and low-noise block converter does not depend, as in the conventional arrangement, on the reflector's thickness and how far those elements' ends extend from mounting flanges. Instead, those ends can be butted against each other.

DETAILED DESCRIPTION OF AN ILLUSTRATIVE EMBODIMENT

Figure 1:
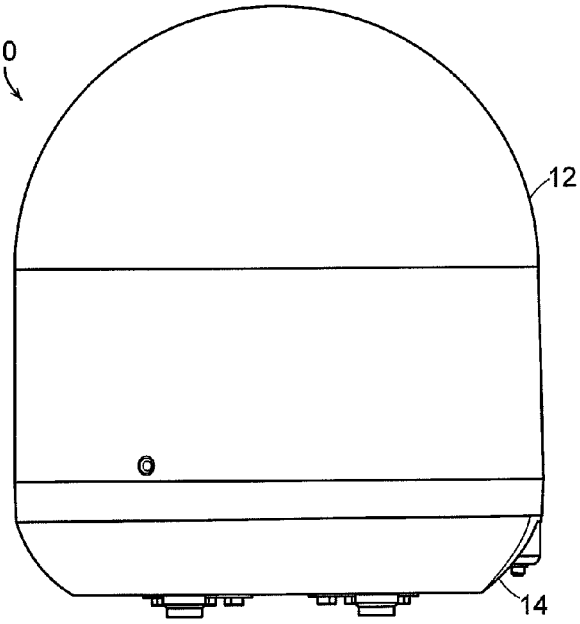
FIG. 1 is a front elevation of a microwave-antenna assembly.
Figure 2:
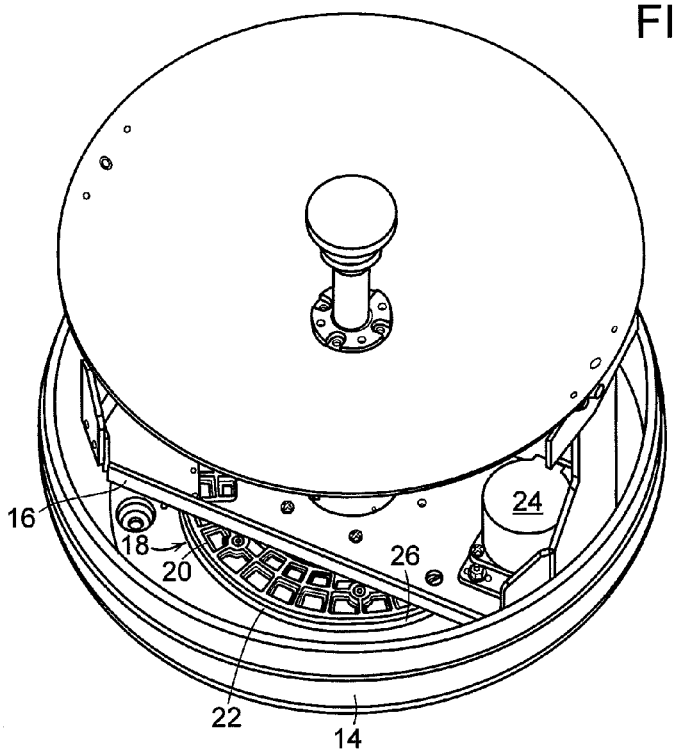
FIG. 2 is an isometric view of the microwave-antenna assembly with parts omitted.

FIG. 1 depicts a typical satellite-antenna installation 10 of the type in which the present invention's teaching can be practiced. The antenna is protected from the elements by microwave-transparent radome 12 secured to a mounting base 14 adapted for mounting on a boat or other mobile platform. FIG. 2 depicts the assembly with the radome removed to reveal a rotating plate 16 journaled to the base 14 by a bearing assembly 18 whose inner race 20 is secured to that plate and whose outer race 22 is secured to the base 14. In response to drive current from control circuitry not shown, an azimuth servomotor 24 mounted on the rotating plate 16 controls the antenna orientation's azimuth component by driving a belt 26 trained about the stationary outer bearing race 22.

Figure 3:
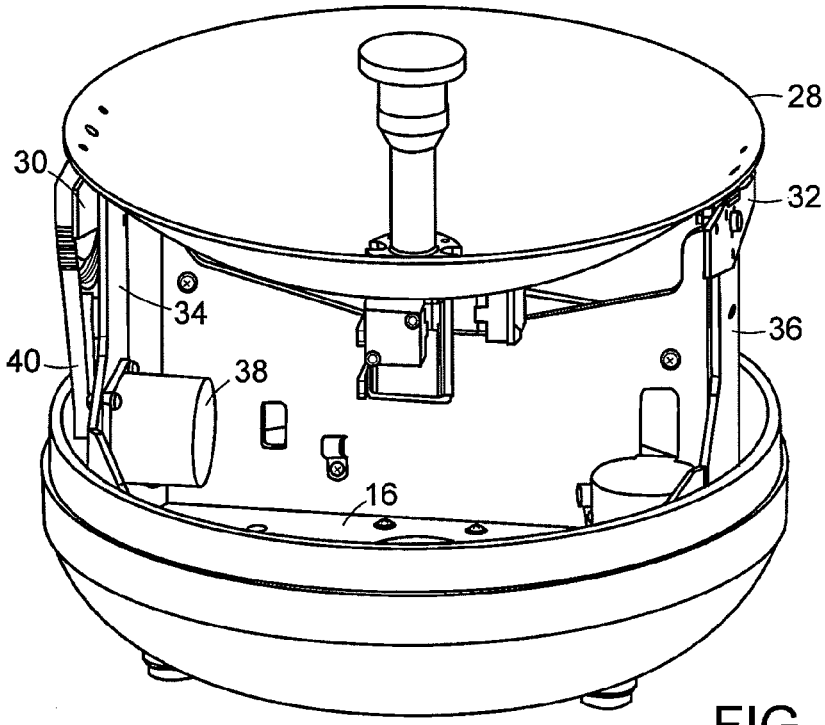
FIG. 3 is another isometric view of the microwave-antenna assembly with parts omitted.

As FIG. 3 shows, the antenna's primary reflector 28 is secured to mounting brackets 30 and 32 pivotably mounted on respective uprights 34 and 36 that extend up from the rotating plate 16. In response to the control circuitry, a second, elevation servomotor 38 mounted on upright 34 controls the antenna's elevation by driving a belt 40 that, as FIG. 4 shows, is trained about the motor's shaft 42, an idler pulley 44 rotatably mounted on upright 34, and a crank gear 46 secured to mounting bracket 30.

Figure 4:
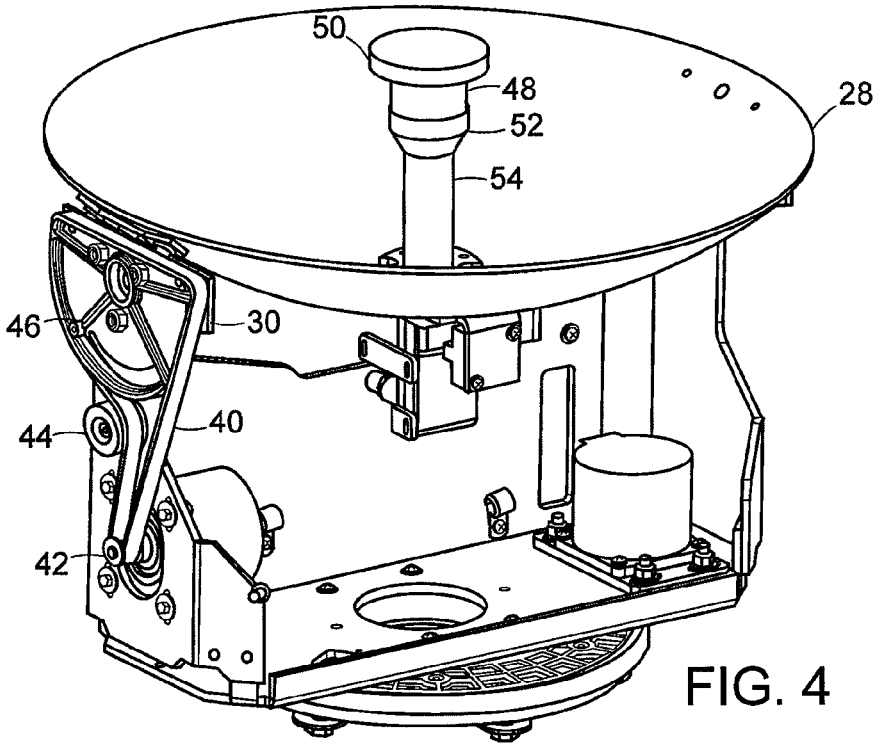
FIG. 4 is yet another isometric view of the microwave-antenna assembly with parts omitted.

The assembly's Cassegrain configuration is also evident in FIG. 4. When the paraboloid primary reflector 28 receives paraxial-path microwaves, it reflects them through a cylindrical microwave-transparent window 48 to a secondary shaped sub-reflector 50 through which the paraboloid's axis extends. The sub-reflector 50 directs the microwaves to the mouth 52 of a feed tube 54, which guides the radiation to a central opening that the primary reflector 28 forms.

Figure 6:
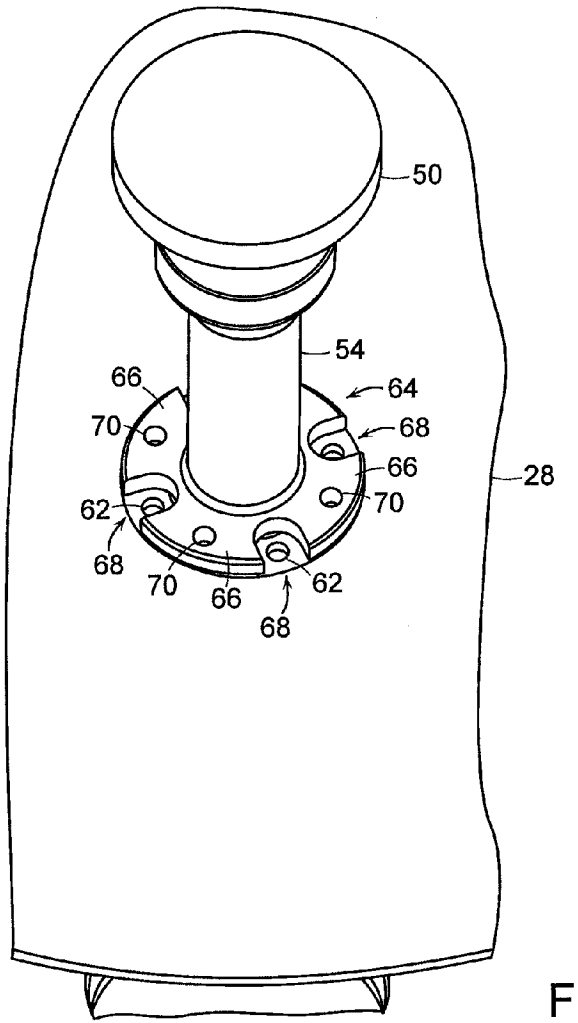
FIG. 6 is a detail similar to FIG. 5 but additionally showing a feed tube that the antenna includes.
Figure 5:
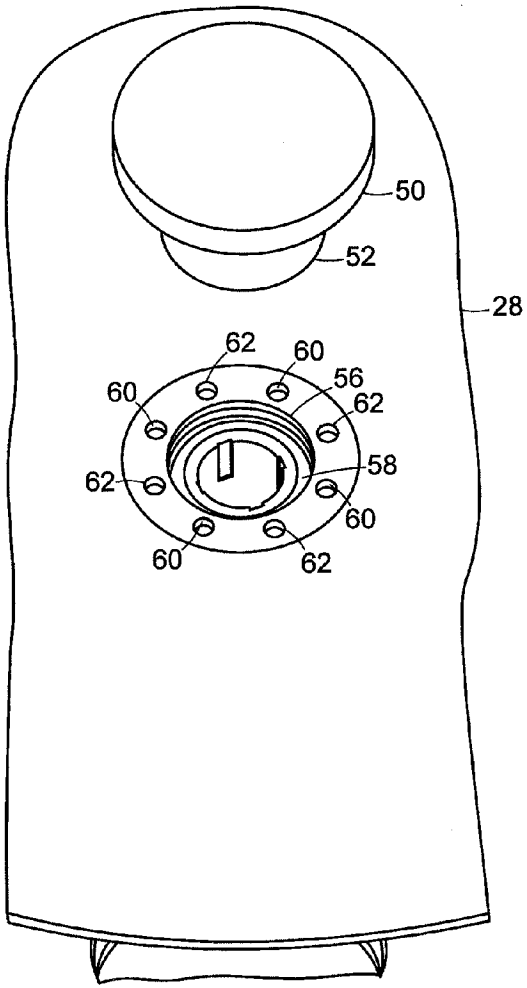
FIG. 5 is a detail of a central opening in the antenna's principal reflector.

FIG. 5, which is a close-up of the primary reflector's central portion with the feed tube removed, shows the primary reflector 28's opening 56 as well as the mouth of a low-noise block down-converter 58, to which the feed tube guides the radiation it receives. FIG. 5 also shows that the primary reflector 28 forms four feed-tube-mounting-bolt holes 60 and four LNB-mounting-bolt holes 62. As can be seen in FIG. 6, where the feed tube 54 has been restored, the feed tube 54 terminates in a flange 64 that forms mounting tabs 66 separated by notches 68 disposed in registration with the LNB-mounting-bolt holes 62. The mounting tabs 66 themselves form bolt holes 70 through which mounting bolts not shown in FIG. 6 extend through the primary reflector's feed-tube-mounting holes 60 (FIG. 5) to secure the feed tube to the low-noise block down-converter, as will be explained in more detail below.

Figure 7:
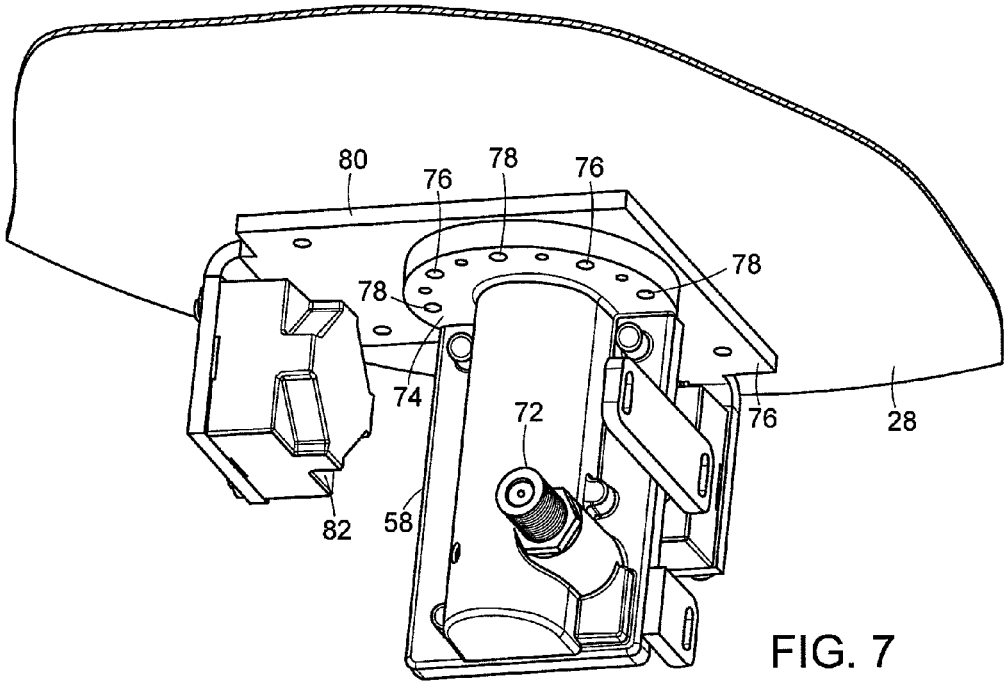
FIG. 7 is a detailed isometric view of the antenna's gyroscopes and low-noise block down-converter.

FIG. 7 shows the primary reflector 28's rear side, where the low-noise block down-converter 58 is located. When the low-noise block down-converter 58 receives microwaves from the feed tube, it amplifies and down-converts to a lower frequency band a block of signals they contain. The low-noise block down-converter 58 provides a connector 72 from which the down-converted signals issue to a cable, not shown, by which they travel to the system's IF strip.

The low-noise block down-converter 58's upper end widens into a flange 74 that forms threaded screw holes 76 and 78 disposed in registration with FIG. 5's holes 60 and 62, respectively. As will presently be explained, screws not shown in FIG. 7 threadedly engage the walls of holes 78 to secure the feed tube to the low-noise block down-converter. Further screws not shown threadedly engage the walls of screw holes 76 to fasten the low-noise block down-converter 58 to the primary reflector 28 and thereby secure between them a bracket 80 on which gyroscopes 82 used for orientation control are mounted.

Figure 8:
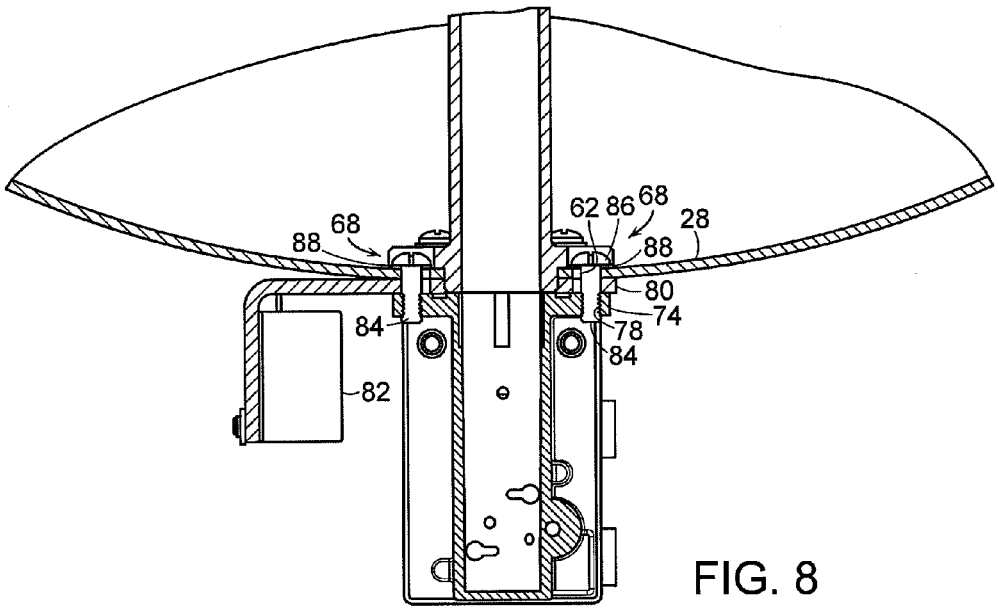
FIG. 8 is a cross section of the antenna assembly taken through the LNB-mounting holes in its primary reflector.

FIG. 8 is a detail of a cross-section taken at the plane through the principal reflector's axis that bisects two of the principal reflector's LNB bolt holes 62. That drawing, which omits internal elements of the low-noise block down-converter, shows two of the four mounting screws 84 that pass through the primary reflector's LNB-mounting holes 62 and threadedly engage hole-78-forming flange walls. Those screws'heads 86 thereby urge washers 88 against the primary reflector 28 to secure the low-noise-block down-converter and bracket 80 to that reflector. From FIG. 6 it will be recalled that the primary-reflector holes 62 through which those screws extend are aligned with the notches 68 in the feed-tube flange, so the feed tube does not have to be included in the operation of mounting the low-noise block down-converter 58 to the primary reflector 28.

Figure 9:
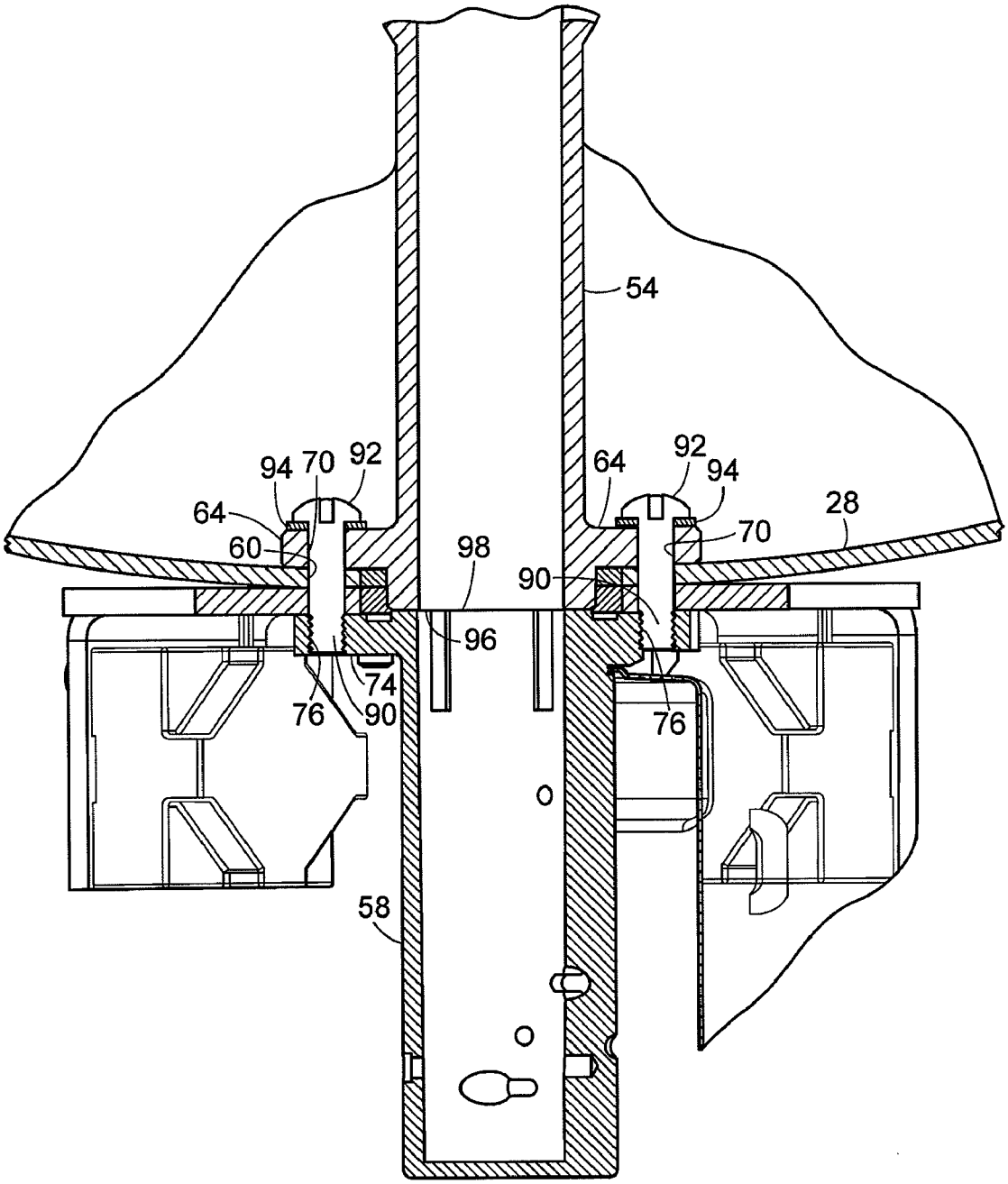
FIG. 9 is a cross section of the antenna assembly taken through the feed-tube-mounting holes in its primary reflector.

The way in which the feed tube is thereafter attached to the low-noise block down-converter can be understood best by reference to FIG. 9, which is a detail similar to FIG. 8 but taken at the plane through the principal reflector's axis that bisects two of the principal reflector's four feed-tube mounting holes 60 (FIG. 5). FIG. 9 shows that two of the four screws 90 that pass through the feed-tube flange 64's mounting holes and the primary reflector's feed-tube mounting holes 60 threadedly engage the hole-76-defining walls formed by the low-noise block down-converter 58's flange 74. Those screws' heads 92 thereby urge washers 94 against the feed tube 54's flange 64.

Since the low-noise block down-converter is already secured to the primary reflector 28, the feed-tube flange 64 does not have to bear against the primary reflector 28 for that purpose, so design tolerances are easily arranged to guarantee that the feed tube 54's lower rim 96 will butt against the low-noise block down-converter 54's upper rim 98. The present invention therefore constitutes a significant advance in the art.

The invention claimed is:

1. A microwave antenna that includes:

A) a base;

B) a primary reflector that forms a central opening, is pivotably mounted on the base, and is so shaped as to define a reflector axis such that the primary reflector directs microwaves received from parallel to the axis to a focal region located on the reflector axis in front of the primary reflector;

C) a sub-reflector so shaped and positioned in the focal region as to reflect microwaves that the primary reflector has directed to the focal region;

D) a low-noise block down-converter of which at least most is disposed behind the primary reflector;

E) a feed tube that forms a feed-tube mouth and is so shaped and positioned as to direct through the central opening and into the low-noise block converter microwaves reflected by the sub-reflector after having been directed to the focal region by the primary reflector;

F) a set of at least one first fastener that secures the primary reflector to the low-noise block down-converter or the feed tube without securing the primary reflector to the other of the low-noise block down-converter and the feed tube; and G) a set of at least one second fastener, separate from every said first fastener, that secures the feed tube to the low-noise block converter;

wherein each said first fastener secures the primary reflector to the low-noise block down-converter without securing the primary reflector to the feed tube.

2. A microwave antenna as defined in claim 1 wherein:

A) the microwave antenna further includes a gyroscope bracket and a gyroscope mounted thereon;

B) the first fasteners so urge the primary reflector and low-noise block down-converter toward each other as to secure the gyroscope bracket between the primary reflector and low-noise block down-converter.

3. A microwave antenna as defined in claim 1 wherein the feed tube includes a feed-tube flange that forms feed-tube fastener holes through which the second fasteners extend.

4. A microwave antenna as defined in claim 3 wherein the feed-tube flange forms tabs through which the second fasteners extend.

5. A microwave antenna as defined in claim 4 wherein each said second fastener is a screw that threadedly engages the feed tube or the low-noise block down-converter.

6. A microwave antenna as defined in claim 4 wherein:

A) the tabs are separated by notches;

B) the primary reflector forms fastener holes aligned with the notches; and

C) the first fasteners extend through the fastener holes thus aligned.

7. A microwave antenna as defined in claim 6 wherein each said first fastener is a screw that threadedly engages the feed tube or the low-noise block down-converter.

8. A microwave antenna that includes:

A) a base;

B) a primary reflector that forms a central opening, is pivotably mounted on the base, and is so shaped as to define a reflector axis such that the primary reflector directs microwaves received from parallel to the axis to a focal region located on the reflector axis in front of the primary reflector;

C) a sub-reflector so shaped and positioned in the focal region as to reflect microwaves that the primary reflector has directed to the focal region;

D) a low-noise block down-converter of which at least most is disposed behind the primary reflector;

E) a feed tube that forms a feed-tube mouth and is so shaped and positioned as to direct through the central opening and into the low-noise block converter microwaves reflected by the sub-reflector after having been directed to the focal region by the primary reflector;

F) a set of at least one first fastener that secures the primary reflector to the low-noise block down-converter or the feed tube without securing the primary reflector to the other of the low-noise block down-converter and the feed tube; and G) a set of at least one second fastener, separate from every said first fastener, that secures the feed tube to the low-noise block converter;

wherein the feed tube and low-noise block down-converter form respective rims that the second fasteners urge into abutment with each other, and wherein each said first fastener secures the primary reflector to the low-noise block down-converter without securing the primary reflector to the feed tube.

9. A microwave antenna as defined in claim 8 wherein:

A) the microwave antenna further includes a gyroscope bracket and a gyroscope mounted thereon;

B) the first fasteners so urge the primary reflector and low-noise block down-converter toward each other as to secure the gyroscope bracket between the primary reflector and low-noise block down-converter.

10. A microwave antenna as defined in claim 8 wherein the feed tube includes a feed-tube flange that forms feed-tube fastener holes through which the second fasteners extend.

11. A microwave antenna as defined in claim 10 wherein the feed-tube flange forms tabs through which the second fasteners extend.

12. A microwave antenna as defined in claim 11 wherein each said second fastener is a screw that threadedly engages the feed tube or the low-noise block down-converter.

13. A microwave antenna as defined in claim 11 wherein:

A) the tabs are separated by notches;

B) the primary reflector forms fastener holes aligned with the notches; and

C) the first fasteners extend through the fastener holes thus aligned.

14. A microwave antenna as defined in claim 13 wherein each said first fastener is a screw that threadedly engages the feed tube or the low-noise block down-converter.

* * * * *